US005678728A

United States Patent [19]

Leto

[11] Patent Number: 5,678,728

[45] Date of Patent: Oct. 21, 1997

[54] DISPENSER FOR FLEXIBLE SHEETS

[76] Inventor: Maria Leto, P.O. Box 336, Sandia Park, N. Mex. 87047

[21] Appl. No.: 493,449

[22] Filed: Jun. 22, 1995

[51] Int. Cl.[6] ..... A01C 00/00

[52] U.S. Cl. ..... 221/185; 221/305; 221/56; 221/52; 221/197; 221/198; 221/281; 221/279; 229/162; 206/812; 206/817; 206/494; 206/233; 224/219

[58] Field of Search ..... 221/185, 305, 221/197, 198, 287, 45, 46, 48, 49, 52, 56, 279, 281; 229/162, 23 A; 206/812, 817, 494, 233, 555, 556; 224/165, 911, 912, 219, 222, 226

[56] References Cited

U.S. PATENT DOCUMENTS

| | | | |
|---|---|---|---|
| 1,797,380 | 3/1931 | Thompson | 221/48 |
| 2,087,181 | 7/1937 | Conway . | |
| 2,122,637 | 7/1938 | Colburn . | |
| 2,347,823 | 5/1944 | Goodman et al. . | |
| 3,343,716 | 9/1967 | Peebles | 221/52 X |
| 3,425,595 | 2/1969 | Shapira | 221/52 |
| 4,185,753 | 1/1980 | Leto | 221/185 X |
| 4,502,612 | 3/1985 | Morrison | 221/185 |
| 4,586,630 | 5/1986 | Loder | 221/46 |
| 4,653,666 | 3/1987 | Mertens | 221/56 X |
| 5,127,545 | 7/1992 | French | 221/185 X |
| 5,219,421 | 6/1993 | Tipping | 221/305 X |
| 5,390,820 | 2/1995 | Wright et al. | 221/305 X |
| 5,509,571 | 4/1996 | Weber | 221/197 X |

*Primary Examiner*—David H. Bollinger
*Assistant Examiner*—Khoi H. Tran
*Attorney, Agent, or Firm*—Robert W. Becker & Associates

[57] ABSTRACT

A dispenser for flexible sheets, especially end wrap papers. The dispenser is designed to be worn on the arm of a user or to be strapped to a stand. The dispenser comprises a box for holding a plurality of the sheets. At least one flap is connected to the bottom or at least one of the sides of the box and projects inwardly. Sheets are adapted to be disposed in the box on that side of the at least one flap that faces away from the bottom. Two flaps can also be provided on the top of the box, with each of these flaps extending from an opposite side half way toward the other side. Each of these top flaps opens in an opposite direction. The top flaps define a slot that permits individual sheets to be held between them and to be individually withdrawn from the box.

19 Claims, 5 Drawing Sheets

DISPENSER FOR FLEXIBLE SHEETS

BACKGROUND OF THE INVENTION

The present invention relates to a dispenser for flexible sheets or pop-up papers, and in particular to a dispenser for end wrap papers or plastic sheets used by beauticians or hair dressers.

End wrap papers and thin plastic sheets are customarily used by beauticians and hair dressers when giving their customers a permanent or otherwise treating their customers' hair. The end wrap papers are small, rectangular sheets of flexible, porous, absorbent paper or fabric. The end wrap papers are used in conjunction with rollers to hold, for example, chemical preparations in place on strands of hair. Thin plastic sheets are chemically treated to provide various treatments for the hair. Such end wrap papers or plastic sheets are typically contained in very lightweight boxes, which causes difficulty in anchoring of the boxes and/or in the ability to withdraw the papers or sheets from the box one at a time.

Several dispensers for flexible sheets are known. For example, U.S. Pat. No. 2,087,181, Conway, discloses a case for housing interlocked sheets that can be removed one at a time. The case is clamped to a hair curler and has a slot for the removal of the sheets. A hinged cover is provided for loading the case. U.S. Pat. No. 2,347,823, Goodman et al, discloses a dispensing container for sheet material. A rigid container is provided that has an opening at the top and has elongated finger-like members for partly closing the opening. A resilient means such as a spring, along with a movable plate, are provided for pressing a stack of sheet material against the top opening and the fingers. The base of the container can be curved to fit on the arm of an operator. U.S. Pat. No. 2,122,637, Colburn, discloses a paper dispenser that is provided with springs that press against a plate that supports sheets of paper.

None of these known dispensers are very satisfactory and do not meet the needs of beauticians. It is therefore an object of the present invention to provide a dispenser from which flexible sheets, and in particular end wrap papers, can be easily withdrawn one at a time. The dispenser must be easy and convenient to use, and must also be economical. In addition, the dispenser should operate without the need for springs.

BRIEF DESCRIPTION OF THE DRAWINGS

These and other objects and advantages of the present invention will appear more clearly from the following specification in conjunction with the accompanying schematic drawings, in which:

FIG. 7 shows the interior of the inventive dispenser and interleafed end wrap papers or thin plastic sheets contained there in;

SUMMARY OF THE INVENTION

Figure 1:
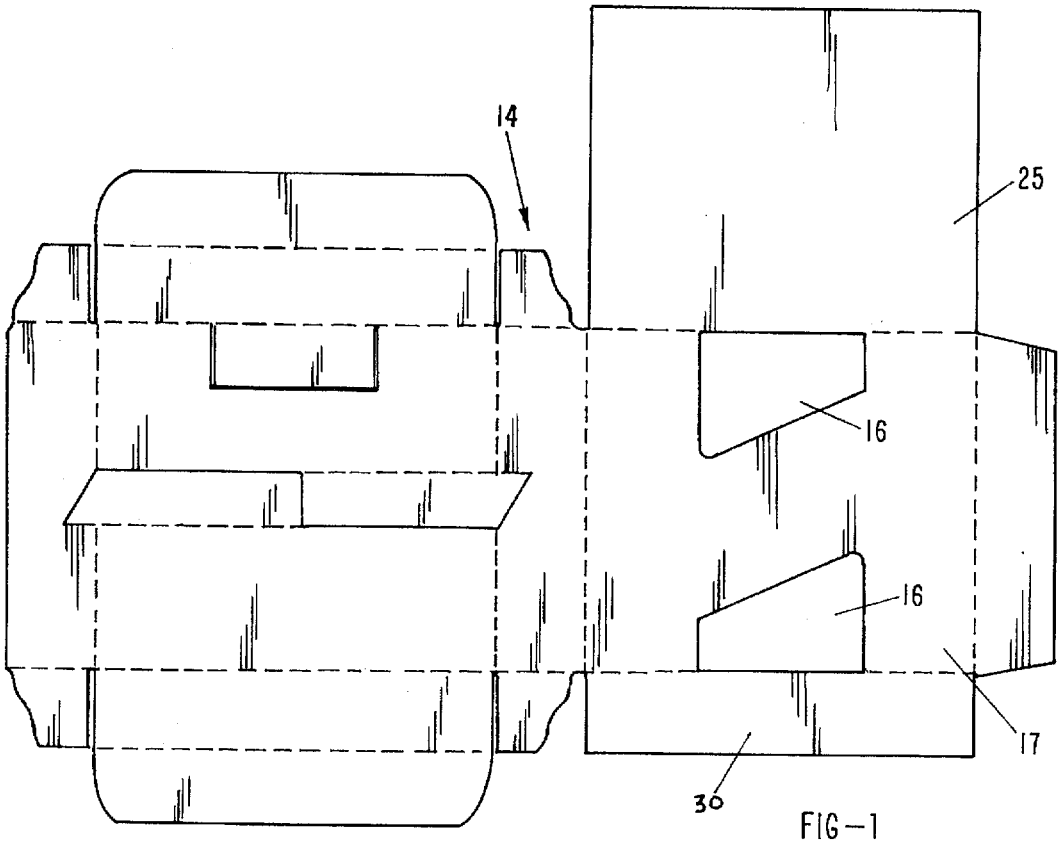
FIG. 1 illustrates one exemplary embodiment of the inventive dispenser in an unfolded state.

The dispenser of the present invention, which can be worn on the wrist or forearm of a user, or can be mounted on a stand, comprises a box for holding a plurality of flexible sheets, especially end wrap papers or thin plastic sheets; at least one flap is connected to the bottom or at least one of the sides of the box and projects inwardly, whereby sheets are adapted to be disposed in the box on that side of the at least one flap that faces away from the bottom.

In addition two further flaps can be disposed on the top of the box in a central region thereof, with each of the flaps extending from an opposite one of the sides of a first set of opposite sides halfway toward the other side of that set of opposite sides, with each of these further flaps opening toward a different one of the sides of a second set of opposite sides, with these flaps defining a slot that permits individual sheets to be held between them and to be withdrawn from the box.

In a particularly straightforward and ecomical manner, the dispenser is made of cardboard, although the dispenser could also be made of any other suitable material, such as plastic or metal. The further flaps are expediently integrally formed with the top of the box and can be folded along a hinge line where the flap connects to the top. The hinge lines can be perforated, prestressed, or otherwise prepared to make it easier to fold the flaps up. Cutouts can be provided on at least one side adjacent to the flaps to provide access to the flap to help in folding the flap up. Such a cutout also makes it easier to lift up the first sheet or end wrap paper in the box.

Another shorter flap is expediently provided on the bottom of the box, opposite the at least one flap, and projects inwardly; the flexible sheets are adapted to be disposed in the box and on top of the at least one flap, which, with the aid of the further bottom flap, helps to urge the sheets toward the top and the slot that is provided there. If a single one of the at least one flap is connected to the bottom, this flap is of substantially the same size as the bottom if the shorter flap is also provided on the bottom. However, if no shorter flap is provided, the single flap can be longer than the bottom, whereupon that portion of this single flap that extends beyond the bottom is folded under, so that it is disposed between the bottom and the remainder of the single flap to thereby exert pressure against the flap to help push it away from the bottom and push the sheets that are disposed on the flap toward the top of the box. Two approximately equally sized flaps could also be connected to opposite sides at the bottom and could overlap one another.

At least one of the sides of the box is expediently adapted to be opened so that the box can be loaded with sheets. A further flap could be disposed on the top of the box adjacent to the at least one side that is to be adapted to be opened. This further flap makes it easier to open that side, and could also serve for access to the papers in the box to make it easier to lift up the first sheet, especially if no cutouts are provided on the sides. In addition, this further flap can be pressed down into a partially used-up dispenser so that it presses against the flexible sheets and helps keep them aligned. A separate cartridge could also be provided for holding a plurality of flexible sheets, whereupon a cartridge would be loaded in the box by means of the at least one side that is adapted to be opened.

To allow the box to be strapped to the arm or wrist of a user, or to be strapped to a stand or other surface, the bottom of the box is expediently provided with two cutouts, whereupon a band, such as a Velcro-type band or any other suitable band, extends through the cutouts and into the interior of the box between the bottom and the flap that is connected thereto. The flap keeps the band from interfering with the sheets in the box, and actually enhances the pushing movement of the flap or flaps against the sheets. The cutouts can be slanted to facilitate positioning of the band.

DESCRIPTION OF PREFERRED EMBODIMENTS

Figure 5:
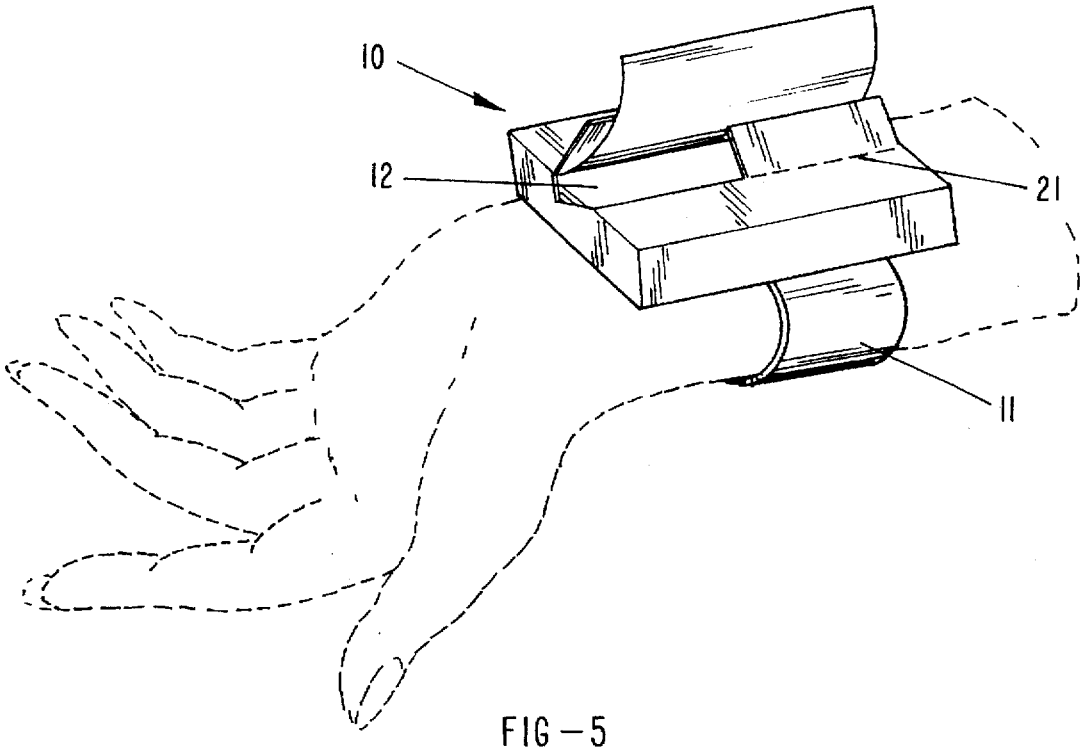
FIG. 5 shows the dispenser of FIG. 3 worn on the inside of the wrist of a person.

Referring now to the drawings in detail, FIG. 5 shows one exemplary embodiment of the inventive dispenser 10 strapped to the inside of the wrist or forearm of a user via a band or strap 11. In the illustrated embodiment, the dispenser 10 is loaded with interleafed flexible sheets in the form of end wrap papers or thin plastic sheets.

In the illustrated embodiment, the dispenser comprises a shaped sheet of cardboard 14 (FIG. 1) that is folded along fold lines (indicated by dashed lines in FIGS. 1 and 2) to form the finished box 15 of the dispenser 10. FIG. 2 shows a partially folded-together box, and also shows a band or Velcro-type strap 11 that has been placed through the cutouts 16 that are provided in the bottom 17 of the box. Although the band or strap 11 is normally not placed through the cutouts 16 in the bottom 17 of the box until the box has been folded together, the band 11 has been illustrated in FIG. 2 to facilitate an understanding of the various features of the dispenser.

Figure 2:
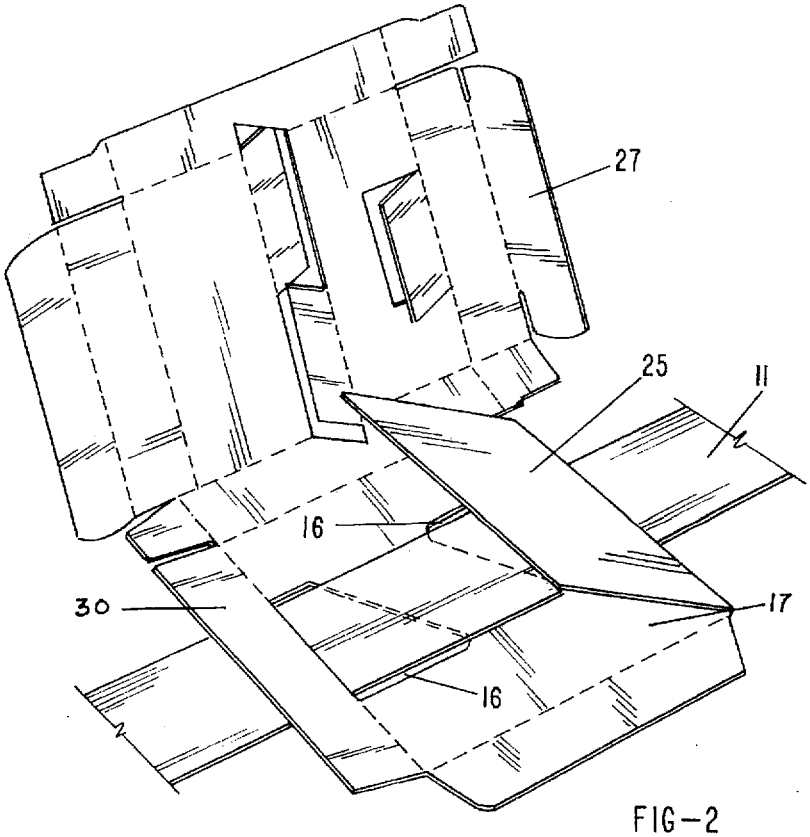
FIG. 2 shows the dispenser of FIG. 1 in a partially folded together state.
Figure 3:
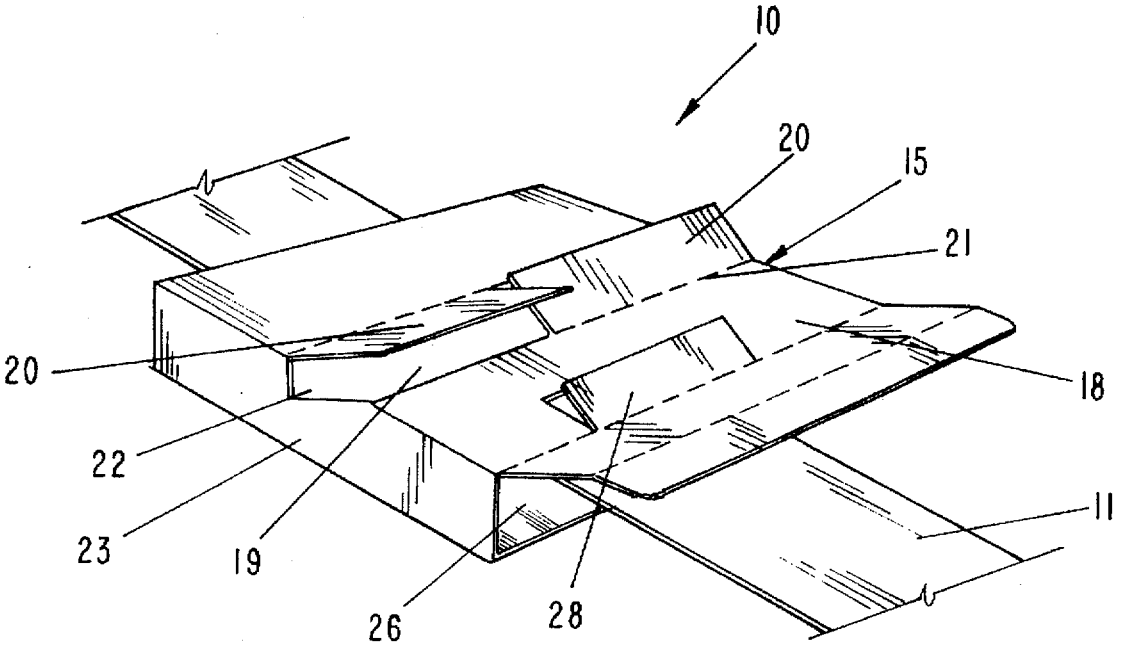
FIG. 3 is a perspective view of the folded together dispenser of FIGS. 1 and 2.
Figure 4:
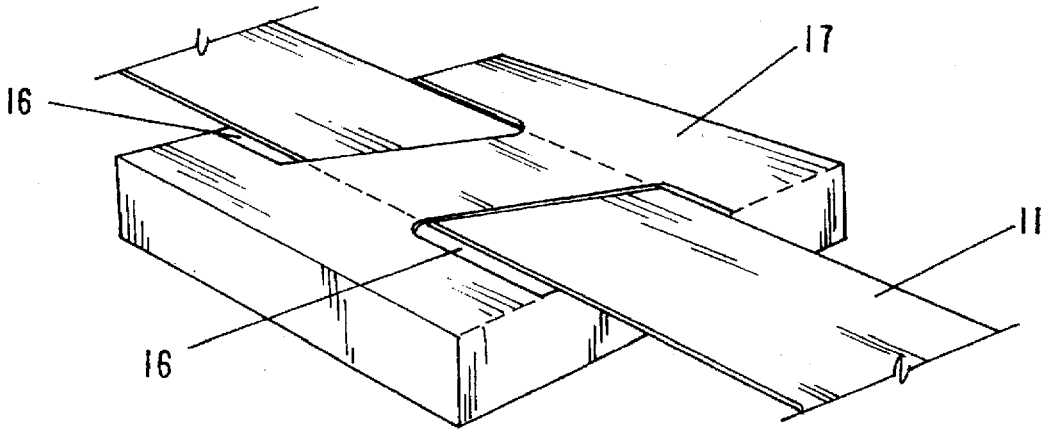
FIG. 4 shows the underside of the dispenser of FIG. 3.

As shown in FIGS. 2 and 3, the top 18 of the box 15 is provided with a slot 19 via which individual ones of the sheets or end wrap papers 12 can be withdrawn. To facilitate this withdrawal process, flaps 20 that define the slot 19 are connected to the top 18 of the box and open in opposite directions. As shown in FIG. 5, the flaps 20 help to hold and guide the sheets 12. To facilitate the movement of the flaps 20, these flaps are connected to the top 18 at the edges of the slot 19 via a perforated hinge line 21. This hinge line 21 can expediently also be a prepressed or prestressed fold line. A cutout 22 can be provided in at least one of the sides 23 of the box 15; cutouts 22 are preferably provided on the two opposite sides 23. These cutouts 22 adjoin the slot 19 next to the flaps 20 and make it easier to initially flip the flaps 20 up to pull the first end wrap paper out through the slot 19 and between the flaps 20. An object such as the tail of a comb handle can also be inserted through a cutout 22 to lift up the first end wrap paper to make it easier to pull this paper out through the slot 19. Although the flaps 20 need not be of equal length as shown, such an embodiment is preferred for properly holding the sheets 12 upright and creating the appropriate tension on them. In addition, in the illustrated embodiment the flaps 20 each extend about ⅜ of an inch from the hinge line 21; to provide proper support for the box top and proper withdrawal of sheets 12, the flaps 20 must not extend too far from the hinge line 21.

To provide an upward movement or pressure against the sheets 12 in the box 15, and/or to protect the sheets 12 from the strap 11, a flap 25 (FIGS. 1 and 2) is connected to the bottom 17. This flap 25 is folded into the interior of the box 15 when the cardboard sheet 14 is folded together. The sheets or papers 12 are then introduced into the box and are disposed between the flap 25 and the top 18. To provide access to the interior of the box, one of the sides of the box, and preferably one of the other sides 26 of the box, can be opened. For example, one of the sides 26 can be formed by a flap 27 that can be tucked in and pulled back out. For ease of insertion of the sheets 12, the flap 27 is preferably disposed at that side 26 of the box 15 that is adjacent to the hinge line where the bottom flap 25 is connected to the bottom 17, as shown in FIG. 2. The opposite side 26 can also be formed by a flap 27 that can be tucked in and pulled back out. A further flap 28 can be provided in the top 18 of the box 15 to facilitate opening of the flap 27 of the side 26 of the box. Pressing inwardly on the flap 28 helps in opening the flap 27. This flap 28 also provides access to the sheets 12 in the box to help lift up the first sheet. This is particularly helpful if no cutouts 22 are provided on the sides 23. In addition, when the box has been partially used up, i.e. a number of the sheets 12 have been used, the flaps 28 can be pressed in and against the remaining sheets 12 to help keep them aligned.

As shown in FIGS. 1 and 2, in a preferred embodiment of the present invention a further shorter flap 30 is connected to the bottom 17 on a side opposite to where the flap 25 is connected to the bottom. When the box is folded together, this additional shorter flap 30 is disposed between the flap 25 and the bottom 17, and thus exerts upward pressure against the flap 25 to urge the flap 25 upwardly to help press the sheets in a direction toward the slot 19 and the flaps 20 thereof. In place of the additional short flap 30, it would also be possible to extend the length of the flap 25, whereby the end of the flap 25, for example that portion of the flap 25 that is longer than the bottom 17, can be folded down under the flap 25 so that it is also disposed between the remainder of the flap 25 and the bottom 17, with this folded-down end portion of the flap 25 serving the same function as the short flap 30.

Figure 6:
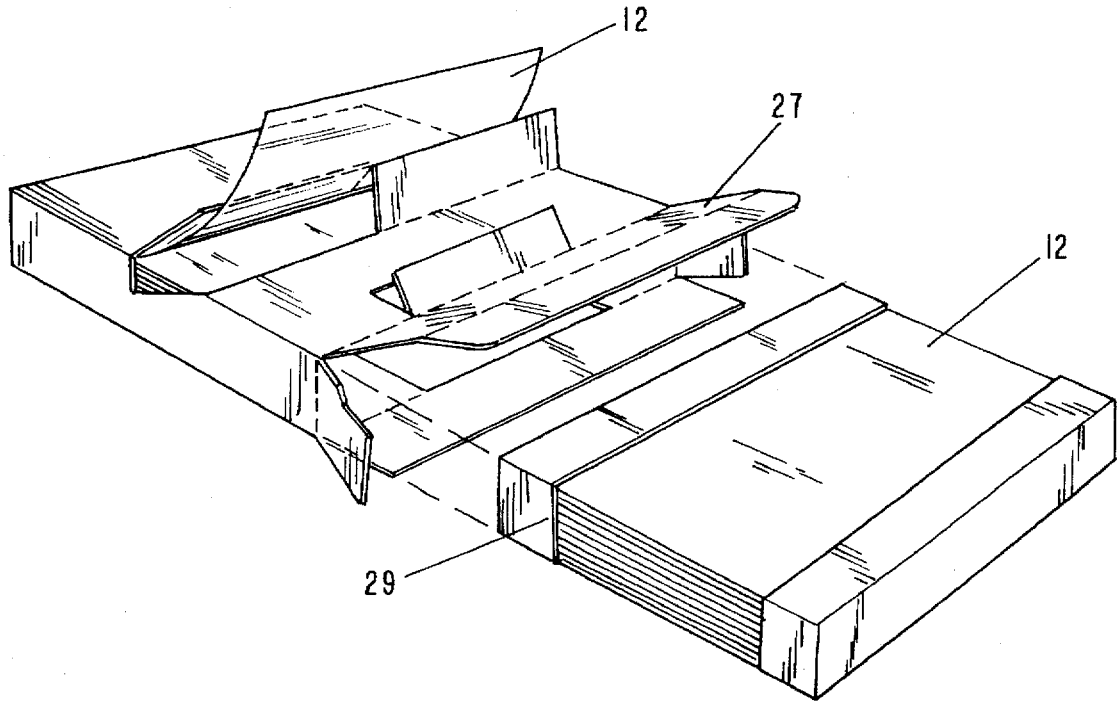
FIG. 6 shows a modification of the embodiment of FIGS. 1–5 wherein the end wrap papers are disposed in a separate cartridge that can be loaded into the dispenser.
Figure 7:
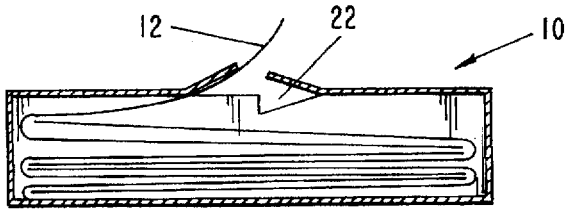

Instead of merely placing a stack of the sheets 12 in the box 15 on top of the flap 25, a cartridge 29 filled with sheets 12 could also be used, as illustrated in FIG. 6. When the box or a previously loaded cartridge 29 is empty, the flap 27 can be opened and, if applicable, the empty cartridge can be removed and a new cartridge 29 or a new stack of sheets 12 can be loaded into the box. It should be noted, however, that due to the unique construction of the inventive box 15, it is by no means necessary to use a cartridge.

Figure 8:
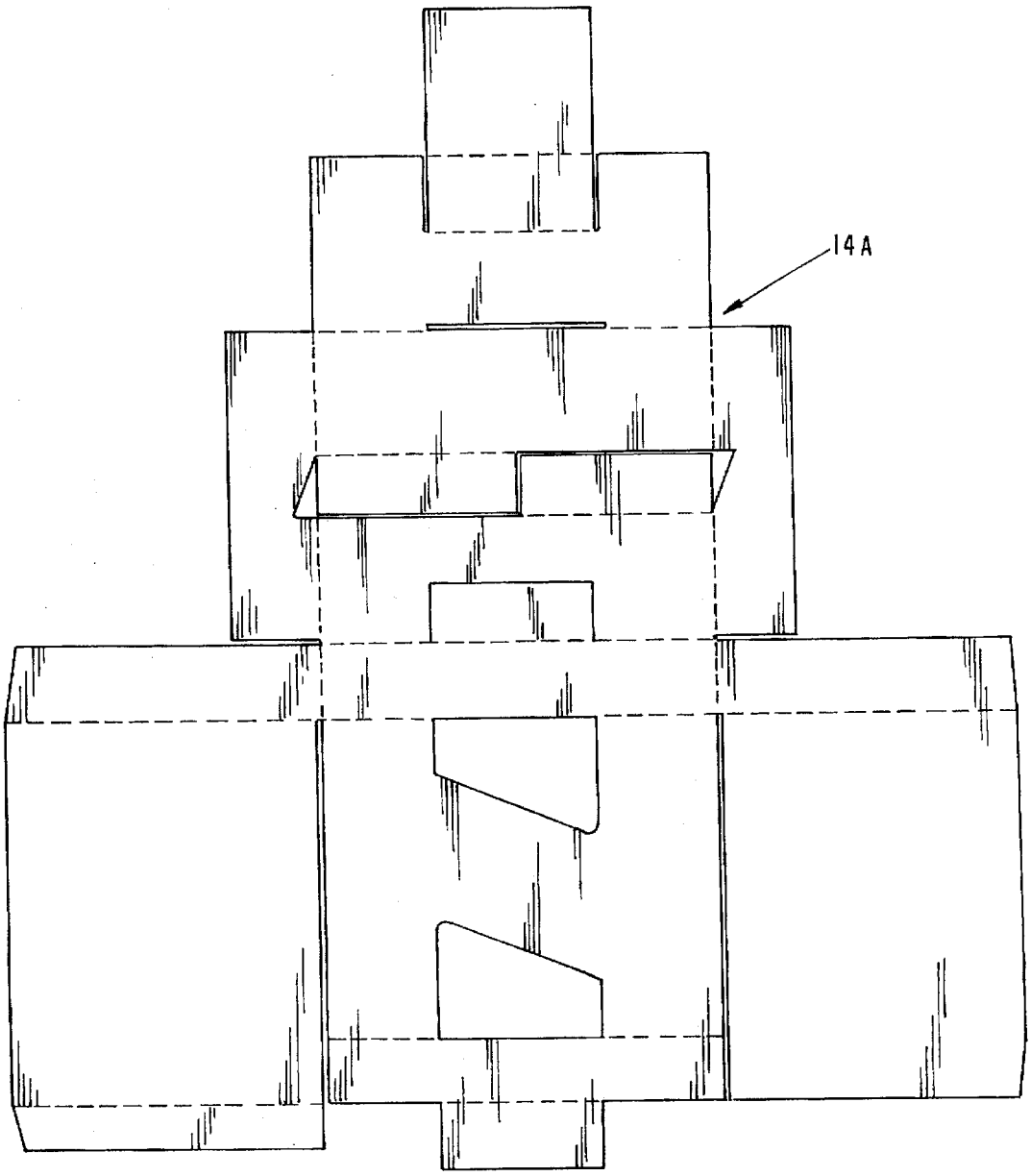
FIG. 8 illustrates a second embodiment of the inventive dispenser in a flat state.
Figure 9:
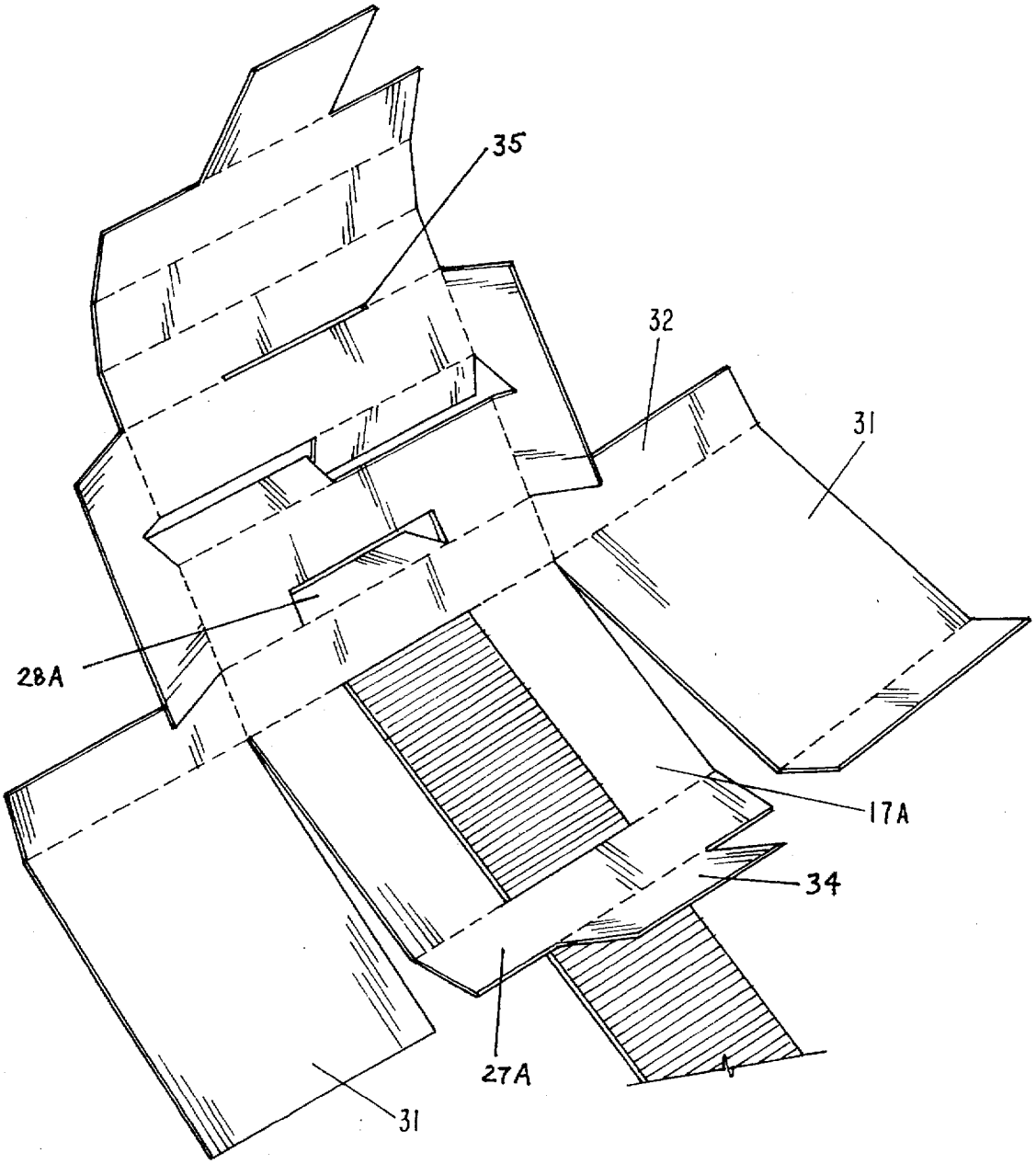
FIG. 9 shows the dispenser of FIG. 8 in a partially folded state.

FIGS. 8 and 9 show a modified sheet 14A for forming the inventive dispenser. In this embodiment, instead of a single flap 25 on the bottom 17, two flaps 31 are provided that overlap one another when the sheet 14A is folded together to form a box. In the illustrated embodiment, the flaps 31 are connected by hinge or fold lines to side portions 32. However, the flaps 31 could also be connected directly to the bottom 17A. The provision of two bottom flaps allows for a little greater pressure against a stack of sheets 12. It should be noted that the double flaps 31, or the single flap 25, also make it easier to thread the strap 11 through the cutouts 16 in the bottom 17 of a folded-together box 15. Since the side 27A is provided with a tab 34 that extends through a slot 35, the flap 28A could even be dispensed with in this embodiment, although the advantages described in connection with the flap 28 are still desirable.

Although the size of the dispenser is dictated by the size of the flexible sheets or end wrap papers that are used, a typical size of the inventive dispenser could, for example, be approximately 2⅝ inches by 2¼ inches on the top and bottom, and ½ to ⅝ inch high. The end wrap papers are typically 2½×4 inches and are folded in half. The papers or sheets are thus provided with C-folds and are interleafed in a manner known per se.

It is also possible to provide an additional protective cover or lid that can be placed over the top of the box to provide some protection to the box, especially if it is made of cardboard, against spillage of water or chemicals. The cover would preferably be made of plastic, and would be in the shape of an open box. In other words, the protective cover would have a top and four sides of an appropriate size to fit over the dispenser. A slot would be provided in the middle of the cover for the flaps 20 and possibly also for the cutouts 22 of the dispenser. A cutout could also be provided for the flap 28.

The present invention is, of course, in no way restricted to the specific disclosure of the specification and drawings, but also encompasses any modifications within the scope of the appended claims.

What I claim is:

1. A dispenser for flexible sheets, comprising:

a box for holding a plurality of flexible sheets, said box having a top, a bottom, and two sets of opposite sides, said top being provided with a slot that permits individual sheets to be withdrawn from said box;

a single first flap that is disposed in a single plane and is connected directly to said bottom of said box and projects inwardly therefrom, whereby sheets are adapted to be disposed in said box on a side of said first flap that faces away from said bottom; and a much shorter separate second flap that is connected to an opposite side of said bottom and is disposed between said bottom and said first flap.

2. The dispenser of claim 1, which comprises a single first flap of substantially the same size as said bottom.

3. The dispenser of claim 1 which comprises a single first flap that is longer than said bottom, with that portion of said first flap that extends beyond said bottom being folded over and being disposed between said bottom and the remainder of said first flap.

4. The dispenser of claim 1, which includes two third flaps disposed on said top of said box in a central region thereof, each of said third flaps extending from an opposite one of said sides of a first one of said sets of opposite sides halfway toward the other side of that set of opposite sides, with each of said third flaps opening toward a different one of said sides of a second one of said sets of opposite sides, said two third flaps defining said slot in said top and permitting individual sheets to be held between them and to be withdrawn from said box.

5. The dispenser of claim 4, wherein said third flaps are integrally formed with said top and can be folded up along a respective hinge line where the respective third flap connects to said top.

6. The dispenser of claim 5, wherein each of said hinge lines is perforated or prestressed to facilitate folding up of said third flap.

7. The dispenser of claim 4, wherein at least one of said sides of said first set of opposite sides is provided with a cutout adjacent to that one of said third flaps that extends from that side.

8. The dispenser of claim 4, wherein at least one of said sides of said box is adapted to be opened to permit said box to be loaded with sheets.

9. The dispenser of claim 8, wherein a fourth flap is disposed on said top adjacent said at least one side that is adapted to be opened.

10. The dispenser of claim of 8, wherein a cartridge is provided for holding a plurality of flexible sheets, said cartridge being adapted to be loaded in said box via said at least one side that is adapted to be opened.

11. The dispenser of claim 4, wherein said bottom, is provided with two cutouts, and wherein a band is provided that extends through said cutouts into the interior of said box between said bottom and said at least one first flap.

12. The dispenser of claim 11, wherein said band is a Velcro-type band that allows said dispenser to be worn on the arm of a person or to be mounted on a stand.

13. The dispenser of claim 11, wherein said cutouts are disposed in a slanted manner on said bottom to facilitate positioning of said band.

14. The dispenser of claim 4, wherein said box and its flaps are made of cardboard that is folded to form said box.

15. The dispenser of claim 1, wherein said flexible sheets are interleafed end wrap papers.

16. The dispenser of claim 1, wherein said flexible sheets are interleafed plastic sheets.

17. The dispenser of claim 4, wherein a cover is provided to protect said dispenser, said cover being in the form of an open box that fits over said top and sides of said dispenser and includes a slot for said third flaps.

18. A dispenser for flexible sheets, comprising:

a box for holding a plurality of flexible sheets, said box having a top, a bottom, and two sets of opposite sides, said top being provided with a slot that permits individual sheets to be withdrawn from said box; and two first flaps connected to opposite sides of one of said sets of opposite sides adjacent said bottom, with said flaps overlapping one another, whereby sheets are adapted to be disposed in said box on a side of one of said first flaps that faces away from said bottom.

19. A dispenser for flexible sheets, comprising:

a box for holding a plurality of flexible sheets, said box having a top, a bottom, and two sets of opposite sides, said top being provided with a slot that permits individual sheets to be withdrawn from said box; and two first flaps connected to different sides of said bottom and overlapping one another, whereby sheets are adapted to be disposed in said box on a side of one of said first flaps that faces away from said bottom.

* * * * *